United States Patent [19]

Clough et al.

[11] Patent Number: 4,672,674

[45] Date of Patent: Jun. 9, 1987

[54] COMMUNICATIONS SYSTEMS

[76] Inventors: Patrick V. F. Clough, 39 Gatton Road, Tooting, London, SW17 OEX; Natividade A. Lobo, 53 Flowers Walk, Ealing, London, W.5., both of England

[21] Appl. No.: 461,489

[22] Filed: Jan. 27, 1983

[30] Foreign Application Priority Data

Jan. 27, 1982 [GB] United Kingdom ..... 8202292
Jan. 27, 1982 [GB] United Kingdom ..... 8202291

[51] Int. Cl.[4] ..... G10L 1/00
[52] U.S. Cl. ..... 381/71; 381/94
[58] Field of Search ..... 381/71, 94, 92, 56, 381/57

[56] References Cited

U.S. PATENT DOCUMENTS 3,995,124 11/1976 Gabr ..... 179/121 D
4,066,842 1/1978 Allen .
4,334,740 6/1982 Wray ..... 381/94 X

FOREIGN PATENT DOCUMENTS 741346 11/1943 Fed. Rep. of Germany .
563595 8/1944 United Kingdom .
960374 6/1964 United Kingdom .
1327834 8/1973 United Kingdom .

OTHER PUBLICATIONS

Widrow et al, "Adaptive Noise Cancelling: Principles and Applications", IEEE Proceedings vol. 63, No. 12, Dec. 1973, p. 1692.
Paul, J. E., "Automatic Digital Audio Processor", IEEE Catalog, No. 77CH1315-1, 1978, pp. 253-258.

*Primary Examiner*—James L. Dwyer
*Attorney, Agent, or Firm*—Laubscher & Laubscher

[57] ABSTRACT

A noise cancelling system comprises two conventional noise cancelling microphones (1,2) spaced apart by a distance of one of up to 10 cms with use of the microphones (1) being arranged to be close to the mouth of a user for reception of speech and the other microphone (2) spaced therefrom and used as a reference microphone. The signals from the microphones are processed by means (7) which use a batch of signals derived from the reference microphone (2) to modify a signal derived from the speech microphone in accordance with the Widrow algorithm known in the art. This system enables effective noise cancellation to be achieved with a delay of only 0.1 sec.

10 Claims, 2 Drawing Figures

COMMUNICATIONS SYSTEMS

BACKGROUND OF THE INVENTION

The present invention relates to improvements in communications systems and specifically to improving the signal to noise ratio of the speech output of a speech transmitting system which is to be used in the presence of loud acoustic noise.

BRIEF DESCRIPTION OF THE PRIOR ART

It is known to provide a speech transmitting system with an enhanced speech to noise ratio which comprises at least two conventional spaced microphones which are arranged so that one microphone receives the speech to be transmitted together with acoustic noise and the other microphone or microphones are sufficiently spaced from the one microphone, for example by at least 300 cm, so that they receive noise but no or substantially no speech. The noise received by the microphones is related but to an undefined, and in general undefinable, extent because of the spacing of the microphones.

The signals from all of the microphones are sampled at predetermined intervals and those from the other microphones are used to provide signals which are the appropriate inverse of the noise component of the signal from the one microphone. The two sets of sample signals are then summed to produce output sample signals from which the noise has been removed to a substantial extent. An error signal is derived from the output signal samples which is fed back to modify the computations made on the signal samples from the other microphones in a direction to improve the speech to noise ratio at the output.

In one known system, the computations performed on the signal samples from the other microphones are as set out in an article entitled "Adaptive noise cancelling: principles and applications" by Windrow et al published in Volume 63, No. 12 of the proceedings of the IEEE.

As set out therein, and considering a system using two microphones, the signals from the two microphones are passed through band pass filters to remove frequencies outside the frequencies in spech and are then sampled at a predetermined frequency. For each sample from the one microphone (which receives noise and speech). a group of samples from the other microphone are selected and multiplied by weighting factors, summed and inverted and then subtracted from the one sample from the one microphone. The number of samples necessary in the group increases with increase in spacing of the microphones, for the same level of speech to noise ratio improvement. For example in known systems at least 100 samples are taken for any group and the computations made on those 100 samples.

Systems of this type have particular application in for example aircraft or helicopter cockpits, engine rooms, flight decks, machine shops and areas around noisy machinery, and for the majority of uses it is essential that the output signal from the system appears with a time delay which will not be appreciated by the speaker, i.e. in less than about 0.1 second. With presently available electronics, this means that the electronic equipment required for processing the signals from the microphones and producing an output signal has to be bulky and therefore expensive and produces a system which requires a substantial amount of space for its installation and is certainly not portable.

In some of the possible uses of such a system, e.g. aircraft cockpits, flight decks, space is at a premium and there is in general no spare space for the installation of such a system. In other potential uses, such as machines shops, areas around noisy machinery etc., it is essential that the system be portable.

SUMMARY OF THE INVENTION

According to the present invention, there is provided communications apparatus comprising at least two microphones each having a good near field response and a poor far field response, one of which is arranged to receive speech and the or each of the other microphones is arranged relatively close to the one microphone but sufficiently spaced or arranged relative thereto that it receives no or substantially no speech, the outputs of the microphones being connected to circuitry for producing an output signal having an enhanced speech to noise ratio.

Microphones which have a good near field response and poor far field response are generally known as noise cancelling microphones and were developed to provide an output which has an improved speech to noise ratio. However, while the ratio is better than for conventional microphones, it has been found impossible to improve it beyond a certain level. Because of the characteristics of such microphones, their response to speech reduces rapidly with distance so that speech will not be received, or not to any substantial extent, by such a microphone which is spaced only a small distance, for example of the order of 10 cm or axis, from the source of speech. This particular characteristic is not of course used directly in conventional use of such microphones but is of paramount importance to the invention of this application because it means that the microphones can be placed close together, for example of the order of 3.5 cm apart.

The effect of reduction in the spacing of the microphones produces a dramatic effect when considering the electronic circuitry and the computations which are required to be done by the system; these can be reduced by a factor of the order of 10 for the same improvement in the speech to noise ratio at the output.

In effect, because of the reduction in the spacing of the microphones, the number of signal samples from the or each other microphone which has to be used to produce a signal for cancelling the noise part of the signal samples from the one microphone can be reduced by a factor of the order of 10.

The consequences of this are that not only can the electronic circuitry be reduced in bulk so that it becomes portable, for example it can be contained within a box of the order of 25 cm by 25 cm by 8 cm but also it can be composed of readily available off-the-shelf components which substantially reduces the cost of the system.

In a preferred system according to the present invention, the computations which are performed are as set out in the above referred to article.

BRIEF DESCRIPTION OF THE FIGURES

An embodiment of a system according to the present invention will now be described by way of example only with reference to the accompanying drawings, in which.

DETAILED DESCRIPTION

Figure 1:
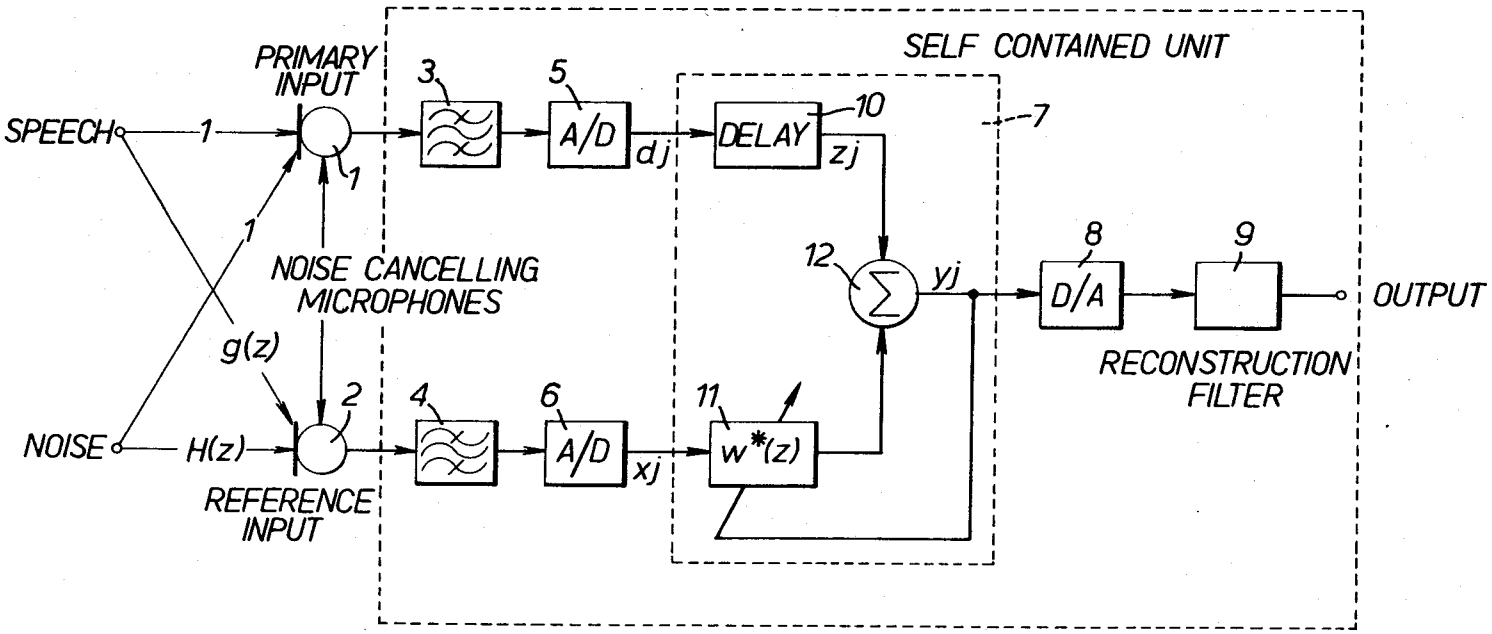
FIG. 1 shows in a block diagram terms a basic form of the system according to the present invention.

As shown in FIG. 1, the system comprises two noise cancelling microphones 1, 2 which may be conventional noise cancelling microphones such as those sold by Knowles Electronics Inc. under the designation CF29/49. The output of each microphone is connected to a band pass filter 3, 4 which removes from the input signals frequencies outside the range 300 Hz to between 5 and 8 kHz. The signals then pass to A/D converters 5, 6 which sample the input signals at a frequency of for example 10 kHz. It will be appreciated that the upper end of the frequency range of the band pass filters is determined in dependance on the sampling rate of the A/D converts to prevent aliasing. The outputs of the A/D converters are connected to a micro-processor 7, for example an AMI S 2811 or NECμ PD 7720. The microprocessor is programmed to implement for example the Windrow-Hoff algorithm set out in the above mentioned article.

The micro-processor 7 is represented as including a delay circuit 10 for delaying signals from the A/D converter 5, a weighting circuit 11 for weighting samples from the A/D converter 6, and a summing circuit 12 for summing the outputs from the delay circuit 10 and the weighting circuit and for providing a control signal which is used to adjust the weighting circuit 11.

The micro-processor is programmed to receive the signal samples from the A/D converters either at the frequency of the A/D converters or at a lower frequency. The samples are stored in memories and progressively withdrawn from store. In respect of each signal sample from microphone 1, a group of samples, for example 32, from microphone 2 are taken. Each sample is multiplied by a weighting factor and the weighted samples are summed, inverted and added to the sample from microphone 1 to produce an output signal sample. The weighting factors are varied, as set out in the article, in dependence on an error signal derived from the output signal sample so as to minimize the mean square of the output.

In the above described embodiment, only two microphones have been used. It will be appreciated that three or more such microphones can be used, for which only one receives speech, the outputs of the other microphones being used to cancel the noise in the signal from the one microphone.

The output from the processor 7 may, as shown, be passed to D/A converter 8 and reconstruction filter 9 or may for example be supplied to a conventional digital radio transmitter for onward transmission and eventual reconstruction as an audible signal.

In a particular embodiment, for use by the pilot of an aircraft, the one microphone may be arranged adjacent the mouth of the user and the or each other microphone is mounted at the back of the head of the user or at some other part of the body of the user. In particular, the two microphones may be arranged on one boom arm, one microphone a few cm. apart from the other so that in use, one microphone is adjacent the mouth and the other microphone adjacent the cheek of the user in which case the two microphones are spaced apart by some 3.5 cm.

The above described arrangement which has two microphones in close proximity results in two signals being obtained where the noise components in both signals have a high correlation.

Using the same standard method proposed by Widrow to process these two signals we have shown experimentally that there is a significant improvement in the system performance when the microphones are 3.5 cm apart as opposed to 15 cm. Several alternative methods of processing the signals could be used.

In general terms the apparatus carries out a method of processing a plurality of signals of which the first represents information plus noise and the or each other represents noise, so as to provide an output signal having an increased information to noise ratio as compared with the ratio of the one signal, the method comprising sampling the signals at constant discreet intervals of time and processing the samples in batches of $N=2^n$, where n is a whole number, the samples of each batch and corresponding batches being processed, wherein the samples of each batch are transformed using an $N\times N$ transformation matrix, the transformed samples from the or each other signal being used to compute signal samples representing the noise in the corresponding transformed signal sample of the first signal, which computed signal samples are subtracted from the corresponding transformed signal samples of the first signal, the resultant signal samples being then transformed using the inverse of the $N\times N$ transformation matrix to provide output sample signals having an increased information to noise ratio.

Advantageously the transformed signal samples from the or each other signal are weighted using an adaptive weighting matrix which is adjusted in dependence on the output signal samples to reduce the mean square of the output.

The $N\times N$ transformation matrix is advantageously one in which:

$$\sum_{i=0}^{N-1} H^{-1}[i,j]H^{*-1}[i,l] = aI[j,l]$$

where a is a constant which may for example be unity and I [j,l] is an $N\times N$ matrix with predominately zero entries. The transformation matrix may for example be the Fourier or Walsh or Hadamard or unitary transformation matrices which are ortho-normal.

In the preferred system, the computations which are performed are as follows:

considering a system with M reference inputs $f^1$, $f^2$, . . . $f^m$, in addition to the first input $f^o$. Consider that $f_k{}^i(j)$ represents the jth sample in the kth batch of the ith reference input, and that gk(j) represents the jth output of the kth batch. As previously mentioned in each batch there are N samples.

In the following H represents the $N\times N$ transformation matrix, e.g. a Fourier or Walsh or Hadamard transformation matrix, and $H^{-1}$ represents the inverse of this transformation matrix. A is an adaptive array of coefficients or weights which are derived, as will appear, from the eventual output signal. $A_k{}^m(l,p)$ is the array of coefficients for the kth batch of the mth input in which l,p vary between zero and $N-1$. Finally λ is a constant which is selected in dependence on the rate of error correction required.

$$F_k^i[j] \overset{df}{=} \sum_{L=0}^{N-1} H[j,l] \cdot f_k^i[l] \quad ①$$

$$g_k[j] = \sum_{L=0}^{N-1} H^{-1}[j,l] \left\{ F_k^o[j] - \sum_{M=0}^{M} \sum_{p=0}^{N-1} F_k^m[p] \cdot A_k^m[l,p] \right\}$$

$$A_{k+1}^n [j,p] = A_k^n[j,p] + 2\lambda \sum_{i=0}^{N-1} \sum_{l=0}^{N-1} F_k^n[p] H^{-1}[ij] H^{*-1} \quad ②$$

$$[il] \times \left\{ F_k^o[L] - \sum_{M=1}^{M} \sum_{r=0}^{N-1} F_k^m[r] \cdot A_k^m[l,r] \right\}$$

In equation ②

$$\sum_{i=0}^{N-1} H^{-1}[l,j]\, H^{*-1}[i,l]$$

is computed initially and stored as B [j,l]. Additionally $$\left\{ F_k^o[l] - \sum_{M=1}^{M} \sum_{p=0}^{N-1} F_k^m[p] \cdot A_k^m[l,p] \right\}$$

is computed once for each of the N values of L for each set of batches of samples from the M inputs.

Advantageously, a dramatic improvement in the number of calculations which are required can be made in the algorithm for producing the adaptive array A by a judicious choice of the transformation matrix H such that B[j,l]=aI[j,l] where a is a constant and I[j,l] is the N×N matrix with predominately zero entries. If I[j,l] is the identity matrix, then equation 2 becomes:

$$A_{k+1}^n [j,p] = A_k^n[j,p] + 2a\lambda\, F_k^n[p] \times \left\{ F_k^o[j] - \sum_{M=1}^{M} \sum_{r=0}^{N-1} F_k^m[r] \cdot A_k^m[j,r] \right\}.$$

In the foregoing, it has been assumed that there are M+1 inputs to the system; considering a simplified system with two inputs $f^o$ and $f^1$, equations 1 and 2 above become $$g_k[j] = \sum_{L=0}^{N-1} H^{-1}[j,l] \left\{ F_k^o[l] - \sum_{p=0}^{N-1} F_k^1[l] \cdot A_k^1[l,p] \right\} \quad ③$$

and $$A_{k+1}^n [j,p] = A_k^n[j,p] + 2a\lambda\, F_k^n[p] \times \left\{ F_k^o[j] - \sum_{r=0}^{N-1} F_k^1[r] \cdot A_k^1[j,r] \right\}^* \quad ④$$

The advantages which arise from using the above N×N transformation matrices, are that the matrices have a number of entries which are zero and can therefore be disregarded. Additionally where the information input is in the form of speech, it is found that only some of the transformed signal samples are significant and those that are not can be set to zero.

Figure 2:
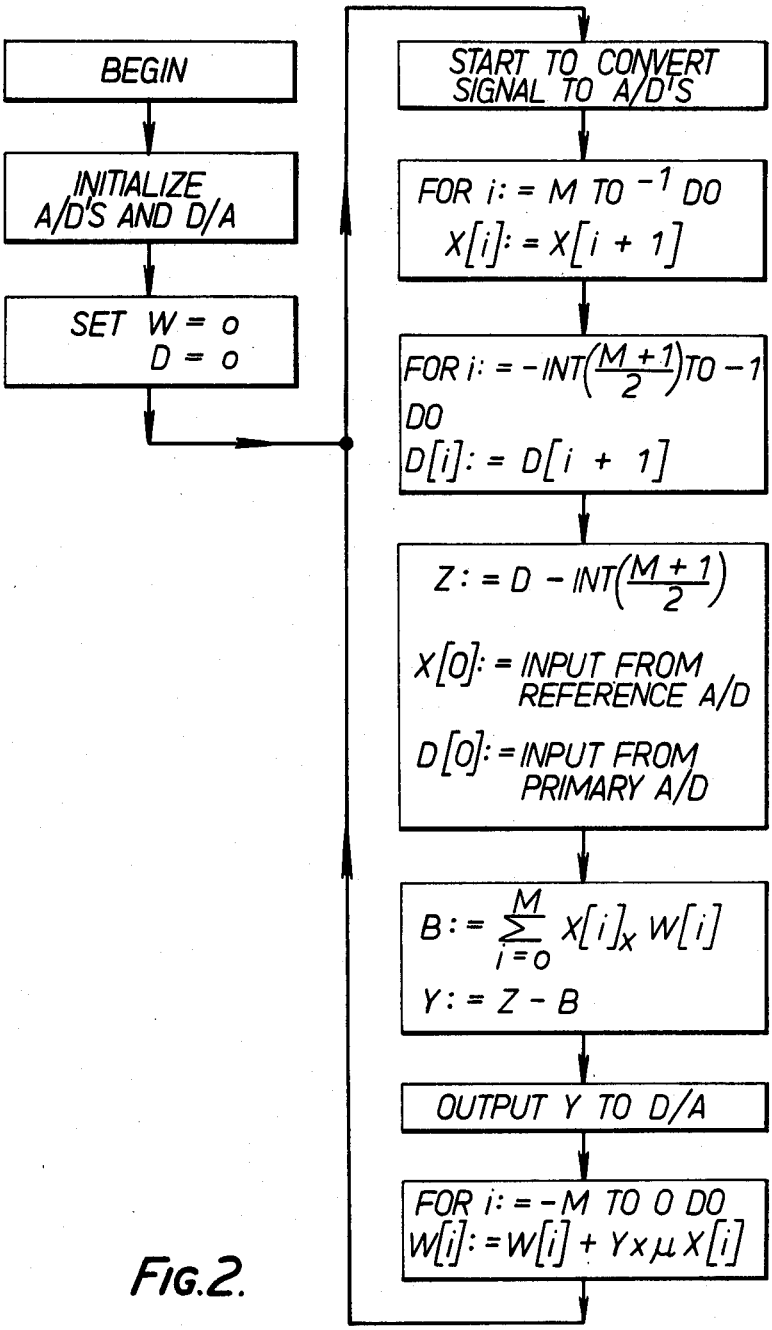
FIG. 2 shows a flow chart of the operations being carried out by the system shown in FIG. 1.

An explanation of how the processor 7 executes the Widrow algorithm mentioned above will now be given in relation to FIG. 2 which shows a flow chart for the processor program.

Let the sampling interval of the A/D converters 5,6 represent the unit of time.

Let dj, xj represent the value of the signal at the A/D converters 5, 6 of the primary and reference channels at the $j^{th}$ instant respectively.

$$\text{Let } \underline{X}(j) = \begin{pmatrix} x_{j-M} \\ \cdot \\ \cdot \\ \cdot \\ x_j \end{pmatrix}$$

$$\text{Let } \underline{W}(j) = \begin{pmatrix} w_{-M}(j) \\ \cdot \\ \cdot \\ \cdot \\ w_o(j) \end{pmatrix}$$

Where $\underline{W}(j)$ represents the weighting vector at the $j^{th}$ instance with components $w_{-M}(j)$ to $w_o(j)$ $$\text{Let } z_j = d_{j-int\left(\frac{M+1}{2}\right)}$$

Where int $(x)$ represents the integer part of $x$

Then the Widrow algorithm is defined by:

$$Y_j = z_j - \underline{X}(j).\underline{W}(j)$$

Where . represents the familiar vector dot product $$\underline{W}(j+1) = \underline{W}(j) + \mu y_j \underline{X}(j)$$

Where $\mu$ is a scaling constant that controls the rate of adaption $\mu$ usually 1/16

In the flow chart $\underline{X}(j)$ is stored in the array $X$ $\underline{W}(j)$ is stored in the array $W$ $d_o d_1 \ldots d_{-int\left(\frac{M+1}{2}\right)}$ is stored in the array $D$ The processor 7 has to have sufficient memory to store the following data:

(i) M previous values and the current value of the reference channel;

(ii) N previous values the current value of the primary (speech) channel where N is the integer part of (M+1)/2; and (iii) M+1 values of the weighting function.

On initially switching on the apparatus, the system is reset and the A/D and D/A converters are initialized. Also, the memory array locations set aside for the weighting function, the reference channel values and the primary channel values are set to zero. Once this has been done, the CPU of the processor sends out a signal to start the A/D converters 5, 6 to convert the analogue signals from the microphones into digital signals.

The contents of the memory locations for signal values, are then updated using the digital signals from the converter 6. Beginning with the location containing the oldest value of the reference signal the contents of the location containing the next oldest value of the reference signal are shifted into the first-sectioned location. This process is repeated until every location containing reference signal samples have been updated except for the location containing the latest value obtained from the A/D converter 6. The process is then repeated for the primary (speech) channel values using other memory locations therefor.

The contents of the location containing the oldest value of the primary (speech) channel is transferred to a memory location labelled Z in the flow chart. For each of the M+1 values of the reference channel that we have stored, we multiply by a corresponding weighting factor that has been stored to produce a value $$B := \sum_{n=0}^{M} x[i] \times W[i]$$

and subtract this from the value stored in the location Z using the summing circuit 12 to produce a resultant value Y which is the output to the D/A converter.

The weights stored in the weighting circuit 11 are then updated as a function of the value Y. The value of each weight is updated by adding to it the result obtained by multiplying the value in location Y by the corresponding primary (speech) channel value and by a scaling factor.

The process is then repeated obtaining fresh digital samples of the analogue signal using the A/D converters 5, 6.

Using the above arrangement and processing technique, all the hardware can be provided in a single self-contained unit to which the microphones may be attached and which has a single output from which relatively noise-free speech can be obtained.

We claim:

1. Apparatus for improving the signal to noise ratio of a communication system, comprising (a) a first microphone having a first field of response for receiving speech signals in a first near field, said first microphone having a poor response to signals in the far field beyond said first field;

(b) at least one second microphone arranged adjacent said first microphone and having a second field of response different from said first field of response for receiving signals other than said speech signals in a second near field, said second microphone having a poor response to signals in the far field beyond said second field;

(c) sampling means connected with said first and second microphones for sampling the speech and other signals at constant discrete intervals of time, the speech signals representing information and noise and the other signals representing noise; and (d) processing means connected with said sampling means for processing a plurality of sampled signals in batches of $N-2^n$ where n is an integer, said processing means producing an output signal having an enhanced signal to noise ratio.

2. Apparatus according to claim 1 wherein there are two microphones spaced apart by a distance of up to 10 cm.

3. Apparatus according to claim 1, wherein there are two microphones spaced apart by a distance of the order of 3.5 cm.

4. Apparatus according to claim 3, wherein the two microphones are mounted on a boom arm.

5. Apparatus according to claim 1, wherein the samples of each batch are transformed using an N×N transformation matrix, the transformed samples from the other signals being used to compute signal samples representing the noise in the corresponding transformed signal sample of the first signal.

6. Apparatus according to claim 5, and comprising means (12) for subtracting computed signal samples from the corresponding transformed signal samples of the first signal, the resultant signal samples being then transformed using the inverse of the N×N transformation matrix to provide output sample signals.

7. Apparatus according to claim 5, and comprising an adaptive weighting matrix (11) for weighting the transformed signal samples from the other signal, the weighting matrix (11) being adjustable in dependence on the output signal samples to reduce the means square of the output.

8. Apparatus according to claim 5, wherein the N×N transformation matrix is one in which $$\sum_{1=0}^{N-1} H^{-1}[i,j]H^{*-1}[i,l] = aI[j,l]$$

where a is a constant and I[j,l] is an N×N matrix with predominantly zero entries.

9. Apparatus according to claim 8, wherein the transformation matrix is a selection of one of a group of matrices comprising the Fourier, Walsh, Hadamard and unitary transformation matrices.

10. Apparatus for improving the signal to noise ratio of a communication system, comprising (a) a first microphone having a first field of response for receiving speech signals in a first near field, said first microphone having a poor response to signals in the far field beyond said first field;

(b) at least one second microphone arranged adjacent said first microphone and having a second field of response different from said first field of response for receiving signals other than said speech signals in a second near field, said second microphone having a poor response to signals in the far field beyond said second field;

(c) sampling means connected with said first and second microphones for sampling the speech and other signals at constant discrete intervals of time, the speech signals representing information and noise and the other signals representing noise; and (d) processing means connected with said sampling means for adaptive signal processing of a plurality of sampled signals in batches of $N-2^n$ where n is an integer, said processing means producing an output signal having an enhanced signal to noise ratio.

* * * * *